US009725904B2

(12) United States Patent
Naccarato et al.

(10) Patent No.: US 9,725,904 B2
(45) Date of Patent: Aug. 8, 2017

(54) ARCHITECTURAL PAVEMENTS IN ELEVATED EXTERIOR DECK APPLICATIONS

(71) Applicant: Casata Technologies Inc., Sault Ste Marie (CA)

(72) Inventors: John R. Naccarato, Sault Ste. Marie (CA); Joseph A. Severini, Saulta Ste. Marie (CA)

(73) Assignee: Casata Technologies Inc., Sault Ste Marie (CA)

( * ) Notice: Subject to any disclaimer, the term of this patent is extended or adjusted under 35 U.S.C. 154(b) by 0 days.

(21) Appl. No.: 14/990,954

(22) Filed: Jan. 8, 2016

(65) Prior Publication Data

US 2016/0356043 A1 Dec. 8, 2016

Related U.S. Application Data

(63) Continuation of application No. 14/527,355, filed on Oct. 29, 2014, now abandoned, which is a (Continued)

(51) Int. Cl.
*E04C 3/04* (2006.01)
*E04F 11/00* (2006.01)
(Continued)

(52) U.S. Cl.
CPC ..... *E04C 3/04* (2013.01); *E04B 1/18* (2013.01); *E04B 5/10* (2013.01); *E04C 3/02* (2013.01); *E04C 3/07* (2013.01); *E04C 3/09* (2013.01); *E04F 11/00* (2013.01); *E04F 11/025* (2013.01); *E04F 11/112* (2013.01); *E04F 15/06* (2013.01); *E04B 2103/06* (2013.01); *E04C 2003/046* (2013.01)

(58) Field of Classification Search
CPC ..... E04F 11/00; E04F 11/025; E04F 11/112; E04F 15/06; E04C 3/02; E04C 2003/046; E04B 1/18
USPC ..... 52/578, 588.1, 579, 592.1, 702, 289, 46, 52/182, 188, 191
See application file for complete search history.

(56) References Cited

U.S. PATENT DOCUMENTS 1,701,304 A 2/1929 Jones, Jr.
1,835,759 A 12/1931 Cook
(Continued)

FOREIGN PATENT DOCUMENTS

GB 361649 A 11/1931

OTHER PUBLICATIONS

Supplemental European Search Report issued in related European Application No. 08849361; search completed Feb. 1, 2016.
(Continued)

*Primary Examiner* — Brent W Herring
(74) *Attorney, Agent, or Firm* — Blake, Cassels & Graydon LLP; John R. S. Orange

(57) ABSTRACT

A deck assembly uses plurality of joists preferably formed from metal located side by side and each having a web portion and a deck portion integrally formed with the web portion. The deck portion extends laterally from the web portion and the joists are spaced from one another such that the deck portions from a continuous deck surface with the joists being connected to one another.

18 Claims, 16 Drawing Sheets

Related U.S. Application Data continuation of application No. 13/849,977, filed on Mar. 25, 2013, now abandoned, which is a continuation of application No. 13/458,553, filed on Apr. 27, 2012, now abandoned, which is a continuation of application No. 12/889,234, filed on Sep. 23, 2010, now abandoned, which is a continuation-in-part of application No. 12/270,645, filed on Nov. 13, 2008, now abandoned, which is a continuation-in-part of application No. PCT/CA2007/001142, filed on Jun. 26, 2007, now abandoned.

(60) Provisional application No. 60/816,348, filed on Jun. 26, 2006, provisional application No. 60/987,528, filed on Nov. 13, 2007.

(51) Int. Cl.

| | |
|---|---|
| ***E04F 11/025*** | (2006.01) |
| ***E04F 11/112*** | (2006.01) |
| ***E04F 15/06*** | (2006.01) |
| ***E04B 1/18*** | (2006.01) |
| ***E04C 3/02*** | (2006.01) |
| ***E04B 5/10*** | (2006.01) |
| ***E04C 3/07*** | (2006.01) |
| ***E04C 3/09*** | (2006.01) |

(56) References Cited

U.S. PATENT DOCUMENTS

| | | | | |
|---|---|---|---|---|
| 1,913,342 | A | | 6/1933 | Schaffert |
| 2,026,278 | A | | 12/1935 | Higley |
| 2,109,655 | A | | 3/1938 | Sylvan |
| 2,180,317 | A | | 11/1939 | Davis |
| 2,424,080 | A | | 7/1947 | Engstrom |
| 2,832,300 | A | | 4/1958 | Jacobson |
| 2,873,008 | A | * | 2/1959 | Ashman ..... E04D 3/30 52/518 |
| 2,899,028 | A | | 8/1959 | Walker |
| 2,933,056 | A | | 4/1960 | Martin |
| 3,023,834 | A | | 3/1962 | Buchanan |
| 3,062,338 | A | | 11/1962 | De Ridder et al. |
| RE25,364 | E | | 4/1963 | Jacobson |
| 3,100,556 | A | * | 8/1963 | De Ridder ..... F16B 5/008 52/283 |
| 3,182,769 | A | | 5/1965 | De Ridder |
| 3,197,934 | A | | 8/1965 | Brown |
| 3,214,889 | A | | 11/1965 | Webster |
| 3,618,281 | A | | 11/1971 | Hill |
| 3,813,839 | A | * | 6/1974 | Simpson, Jr. ..... E04B 5/10 52/394 |
| 3,839,836 | A | | 10/1974 | Payne |
| 3,839,840 | A | | 10/1974 | Miller |
| 3,897,665 | A | | 8/1975 | Yokomori |
| 4,454,695 | A | | 6/1984 | Person |
| 4,713,921 | A | | 12/1987 | Minialoff et al. |
| 4,741,134 | A | | 5/1988 | Stohs |
| 4,741,138 | A | | 5/1988 | Rongoe |
| 4,899,504 | A | | 2/1990 | Hirschhorn |
| 5,513,472 | A | | 5/1996 | Olsen et al. |
| 5,660,009 | A | | 8/1997 | Cousin |
| 5,685,118 | A | | 11/1997 | Simpson |
| 5,697,197 | A | | 12/1997 | Simpson |
| 5,941,035 | A | | 8/1999 | Purse |
| 6,085,485 | A | | 7/2000 | Murdock |
| 6,658,808 | B1 | | 12/2003 | Doherty et al. |
| 6,889,478 | B1 | | 5/2005 | Simpson |
| 6,918,221 | B2 | | 7/2005 | Williams |
| 7,021,012 | B2 | | 4/2006 | Zent et al. |
| D608,468 | S | | 1/2010 | Naccarato et al. |
| D608,469 | S | | 1/2010 | Naccarato et al. |
| D608,470 | S | | 1/2010 | Naccarato et al. |
| 7,793,470 | B1 | | 9/2010 | Mathiesen et al. |
| 8,474,196 | B2 | | 7/2013 | Marriott |
| 2002/0069606 | A1 | | 6/2002 | Gosselin et al. |
| 2005/0284058 | A1 | | 12/2005 | Zeng et al. |

OTHER PUBLICATIONS

International Search Report from PCT/CA2007/001142; search completed Oct. 18, 2007.
U.S. Appl. No. 14/527,355, filed Oct. 29, 2014.
U.S. Appl. No. 13/849,977, filed Mar. 23, 2013.
U.S. Appl. No. 13/458,553, filed Apr. 27, 2012.
U.S. Appl. No. 12/889,234, filed Sep. 23, 2010.
U.S. Appl. No. 12/270,645, filed Nov. 13, 2008.
PCT/CA2007/001142, Jun. 26, 2007.
U.S. Appl. No. 60/987,528, filed Nov. 13, 2007.
U.S. Appl. No. 60/816.348, filed Jun. 26, 2006.

* cited by examiner

ARCHITECTURAL PAVEMENTS IN ELEVATED EXTERIOR DECK APPLICATIONS

CROSS-REFERENCE TO RELATED APPLICATIONS

The present application is a continuation of U.S. patent application Ser. No. 14/527,355 filed Oct. 29, 2014, which is a continuation of U.S. patent application Ser. No. 13/849,977 filed Mar. 25, 2013, now abandoned, which is a continuation of U.S. patent application Ser. No. 13/458,553 filed Apr. 27, 2012, now abandoned, which is a continuation of U.S. patent application Ser. No. 12/889,234 filed Sep. 23, 2010, now abandoned, which is a continuation-in-part of U.S. application Ser. No. 12/270,645 filed Nov. 13, 2008, now abandoned, which is a continuation-in-part of International PCT Application No. PCT/CA2007/001142 filed on Jun. 26, 2007, now expired, which claims priority from U.S. Provisional Application No. 60/816,348 filed Jun. 26, 2006 the contents of which are all incorporated herein by reference. U.S. patent application Ser. No. 12/270,645 filed Nov. 13, 2008 also claims priority from U.S. Provisional Application No. 60/987,528 filed Nov. 13, 2007, the contents of which is also incorporated herein by reference.

FIELD OF THE INVENTION

The present invention relates to an integrated platform joist, an integrated platform joist system, and a method for assembling such a system.

DESCRIPTION OF THE PRIOR ART

Joist systems are used in the construction industry to span a distance between opposing walls and provide a structural support for a floor, a roof or other platform. The joists are individual units spaced apart and support a decking that forms a sub-floor. Such joists can be manufactured from a variety of materials including softwood, wood based laminates, metals and metal alloys.

Joists manufactured from a metal, in particular steel, may be fabricated in an open-web configuration or in a roll-formed configuration. Open-web joists consist of spaced-apart upper and lower chord members that are connected with truss members such as steel rods. Typically, open-web joists are coated or finished with a coloured primer. Roll-formed joists are generally shaped from sheet-steel and cold-formed into a shape, such as a C-shape when viewed in cross section. Other configurations may include the assembly of multiple cold-formed sections to form an I-shape section. Roll-formed joists can be made from hot-rolled steel, cold-rolled steel, metallic-coated sheet-steel, and/or painted steel. Such joists are intended to be located at spaced locations and provide point supports for the decking.

Traditionally, joist systems have required bridging of the upper and lower chord members to brace the joists laterally to resist twisting during, or after installation. Sub-floors, or roofing, or sheathing of various materials is then usually installed on top of the joist system. These joist systems sometimes require multiple fastening means, such as, for example, a tongue and groove joint between the sub-floor components, an adhesive to secure the sub-floor to the joist and a screw to hold the sub-floor in situ and a bolt a rivet or a weld.

Over the years, the building industry has introduced various types of composite steel concrete and non-combustible floor and roof systems in which the upper chord members are embedded within a concrete slab. The concrete slab has both load bearing and fire resistant properties. Examples of such composite joist can be found in U.S. Pat. Nos. 5,941,035; 4,741,138; and 4,454,695 and US Patent Publication Number 2002/0069606 A1. A composite joist design permits the upper chord member of a joist to be designed with less steel in comparison with the non-composite system, since the concrete slab, when properly bonded to the upper chord member, provides additional load support for the floor or roof system.

One of the major drawbacks of modern joist systems is that they require substantial time to erect. They are also dependent on the availability of skilled labour.

It is an object of the present invention to obviate or mitigate the above-mentioned drawback.

SUMMARY OF THE INVENTION

Accordingly, the present invention provides a deck assembly comprising a plurality of joists located side by side and each having a web portion and a deck portion integrally formed with the web portion. The deck portion extending laterally from the web portion and said joists being spaced from one another such that the deck portions form a continuous deck surface with said joists being connected to one another in a nested engagement.

The adjacent joists, once assembled in nested engagement, may be secured together using fastening means. The fastening means may be selected from the group consisting of a screw, a nail, a bolt, an adhesive, a weld, a folded seam and a toggle lock.

The joist system may have various sectional designs depending on the application the joist system is to be used for. The web and deck portions may each include ribbing, or other reinforcement means to resist deflection of the platform system during use. Most preferably, both the web and deck portions of the joist are provided with ribbing or other reinforcement means.

At the intersection of the deck portion and web portion, the deck portion preferably is jogged inwardly to provide an offset shelf section running longitudinally along the length of the joist. The shelf section is set below the upper surface of the deck portion to provide support for the distal edge of the deck portion of an adjacent joist. The distal edge of the deck portion is also jogged inwardly to provide an offset shelf section running longitudinally along the length of the joist. The offsets are relatively dimensioned such that when a tail of one joist is supported on the shelf section of an adjacent joist, the deck portions lie in a common plane. These continuous longitudinal offsets are recessed into the plane of the deck portion to allow for nesting and fastening while maintaining a singe horizontal datum surface on which to apply stone pavers, tiles, or the like on a common datum surface and minimize rocking, splitting or cracking of stones or pavers due to an uneven surface or the projection of the fastener heads above the datum surface. In a nested configuration, the continuous longitudinal offsets provide increased sectional rigidity which contributes to limit vertical deflections and resist crippling under loading conditions, and achieves a structural efficiency that is not achievable with a single piece structural element of similar thickness. The next joist is then positioned with its tail resting on the shelf section of the preceding joist. The wider shelf section allows the tail to be adjusted along the length of the joist to maintain the required alignment between the joists and provides for flexibility of alignment and pitch during assembly of the joists to accommodate variability and dimensional inaccuracies of structures in an as-built condition. Normally, such an alignment is parallel to one another, but in some circumstances the joists may be fanned relative to each other to provide an arcuate surface in plan. With the joists positioned, fasteners are inserted through the tail and shelf section, and fasteners inserted through the flange in to the supporting beam.

The deck assembly may optionally comprise lower chord bridging to span an open area beneath the platform portion of the joist to provide increased structural rigidity, and prevent the platform from tortionally deforming.

According to a further aspect of the present invention there is provided a joist for use in a deck assembly, said joist having a web portion integrally formed with a deck portion that projects laterally to one side of said deck portion and has a distal edge for connection to an adjacent joist, whereby said deck portion maintains said web portions of adjacent joists in spaced relationship and provides a continuous deck surface between said web portions.

Preferably, the joists of the deck assembly are manufactured from a metal or a metal alloy, such as flat rolled steel with a galvanized or organic coatings to prevent corrosion. Alternatively, the joists may be manufactured from prepainted steel, a composite material, or a plastics material, depending on the intended use and loading conditions. The joists of the deck are preferably manufactured using light gage galvanized steel in thickness of between 1 mm and 3 mm with 1.42 mm to 2 mm preferred, to provide a lightweight structure for ease of assembly of a deck and satisfying structural performance conditions required by applicable building regulations.

The joists, when manufactured from a metal or a metal alloy, may be formed by cold-forming techniques such as roll-forming, stamping, or a combination thereof. Alternatively, the joist may be extruded into a desired shape when said joist is manufactured from aluminium, a plastics material, or a composite material.

Preferred uses of the deck assembly in accordance with the present invention include flooring systems; sub-floor systems (including for use with a patio); transverse or longitudinal walkways; stairway treads; specialty floors, for example, raised floors for computer rooms, electronic and other manufacturing plants and the like and flat or pitched roof systems. The selection of material thickness and dimensions of the joist are dependent on achieving minimum structural performance for static and dynamic loading, deflection, and flexural strength of the architectural pavements.

The present invention also provides a method for assembling a deck assembly in accordance with the present invention; on top of a suitable support structure which may comprise beam supports, column supports, wall supports or combinations thereof; which method comprises the steps of a) intercalating a pair of adjacent platform joist in nesting engagement and b) fastening the platform joists to each other to create a continuous deck surface.

Before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

BRIEF DESCRIPTION OF THE DRAWINGS

The features of the invention will become more apparent in the following detailed description in which reference is made to the appended drawings wherein.

In the figures, like numerals denote like parts.

DETAILED DESCRIPTION OF THE INVENTION

Figure 1:
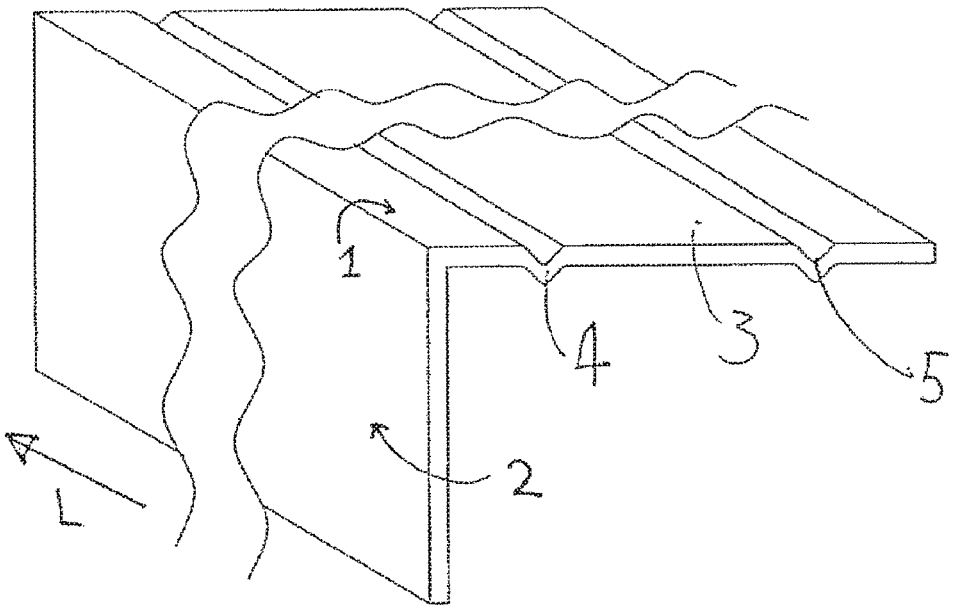
FIG. 1 is a sectional view of a joist for use in the deck assembly.

Referring to FIG. 1, a joist 1 for use in a deck assembly 40 comprises a web portion 2 and a deck portion 3. It will be appreciated that the joists are of indeterminate length L and may be customized to the length required. The deck portion 3 extends outwardly from the web portion 2 and the included angle between the deck portion 3 and web portion 2 is typically 90°, although other angles may be incorporated. The deck portion 3 is provided with a pair of V-shaped recesses 4, 5 at spaced locations that are proximal to and distal from the web portion 2 respectively. The joist 1 is formed from a rolled steel strip of appropriate gauge and the joists 1 may be pre-finished by painting, powder coating or galvanizing to inhibit corrosion.

Figure 2:
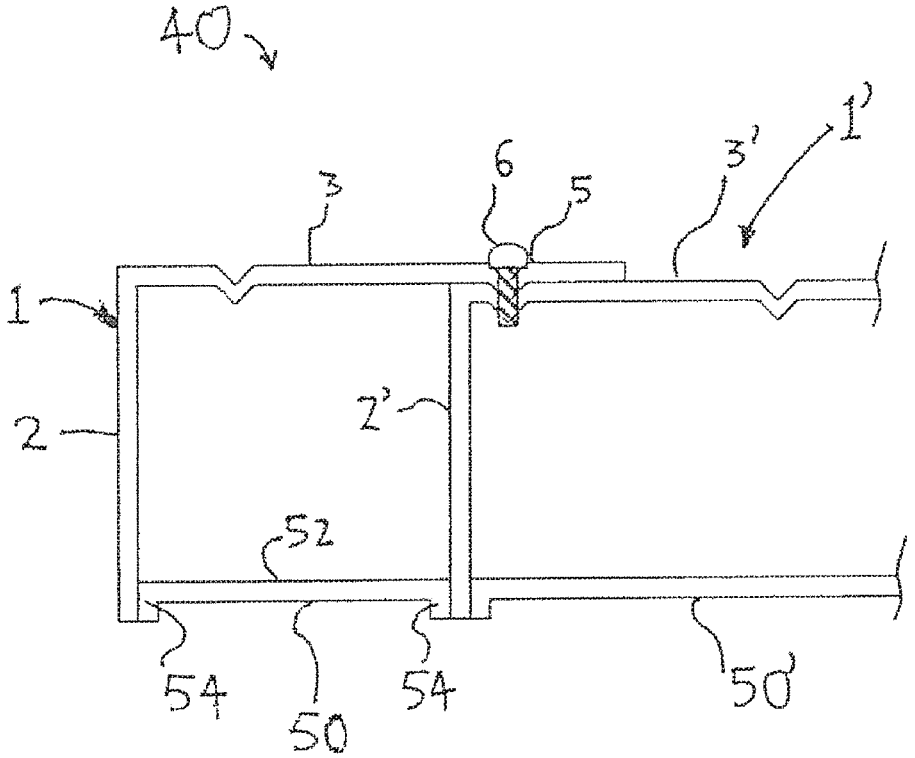
FIG. 2 is a sectional view showing a deck assembly comprising two joists of FIG. 1.

A plurality of joists 1, 1' of FIG. 1 are assembled as shown in FIG. 2 to form a deck assembly 40. The web portions 2, 2' of each joist are aligned vertically in parallel with the deck portions 2, 2' overlapping. The distal V-shaped recess 5 engages the recess 4 to provide a positive inter-engagement of the decking portions 3, 3'. The joists 1, 1' are joined together by fasteners 6, such as self tapping screws or pop rivets to form an integral unit. A lower chord bridge 50, 50' is located between upstanding portions of adjacent joists spaced from the deck portion to provide additional support and prevent tortional deformation of the deck assembly 40.

The bridge 50, 50' has a planar body 52 with a pair of flanges 54 that are secured to the webs 2, 2'. The bridges 50 maintain the webs 2, 2' in spaced relationship and provide a box section to enhance the structural rigidity. The bridges 50 may be continuous along substantially the entire length of the joist 1 or may be relatively short lengths spaced apart along the joist 1 to provide rigidity of select locations.

The joists 1 may be added side by side to the deck assembly 40 to provide a platform of the required width and length. The individual joists are relatively light to handle and assemble but provide high strength and rigidity when in place. The joists 1 may be fastened together with mechanical fasteners, such as screws, bolts, clips or rivets, or may be permanently connected, as for example by welding. In typical applications for a residential deck, the joists 1 are formed from rolled steel strip having a thickness of between 1 mm and 3 mm with 1.42 mm to 2 mm preferred. The deck portion 3 has a lateral extent dependent on structural requirements, and is typically between 10 inches and 16 inches, and preferably 12 inches. The web has a height of between 3½ inches and 8 inches with a preferred height of 5½ inches. In a nested arrangement, the spacing between adjacent web portions is dependent on structural requirements, and is typically between 10 inches and 14 inches, and preferably 10 inches. For such application, a joist length L of 12 feet has been found appropriate spanning a distance of 8 feet between beams. The dimensions may be varied to suit the loading and the unsupported span as per normal engineering practices.

The deck assembly 40 may be used as the final platform or may be used to support a non structural decking surface, such as slate, stone, porcelain tile, concrete or exotic hardwood. The deck assembly may also be used as a roof deck with a membrane bonded to the deck portions 3 after assembly.

Figure 3:
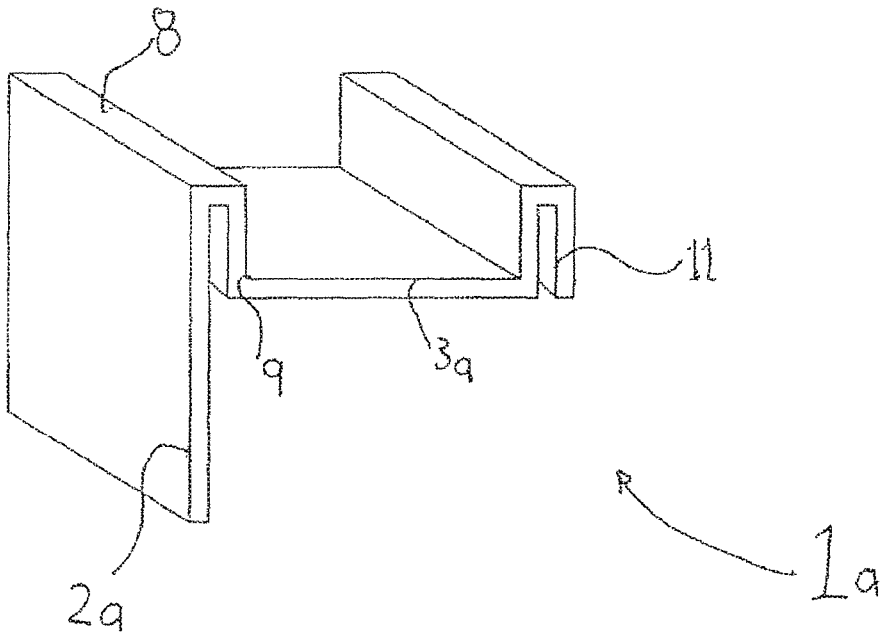
FIG. 3 is a sectional view of an alternative joist.

Referring to FIG. 3, an alternative design of a joist 1 of the deck system is shown in which like components will be identified with like reference numbers with a suffix a added for clarity. The joist 1*a* comprises a web portion 2*a* and a deck portion 3*a*. One end of the web portion 2*a* includes a raised parapet structure 8 where part of the web portion 2*a* is bent back on itself and projects above the deck portion 3*a*. The deck portion 3*a* extends outwardly from the parapet.

The distal edge of deck portion 3*a* has an upstanding rib 11 of complimentary configuration to the parapet 8 of an adjacent joist 1*a* of the deck assembly 40.

The parapet 8 and rib 11 provide inter-engaging male and female portions that are exaggerated compared with the recesses 4, 5 in FIG. 2 but perform a similar function.

In use, the ribs 11, 11' of a first joist 1*a* intercalates with the return portion 8 of corresponding configuration on an adjacent joist 1*a*'. The resulting seam 12 formed by the intercalating male and female portions is then secured together using a suitable fastening means, either mechanical or by welding.

Figure 4:
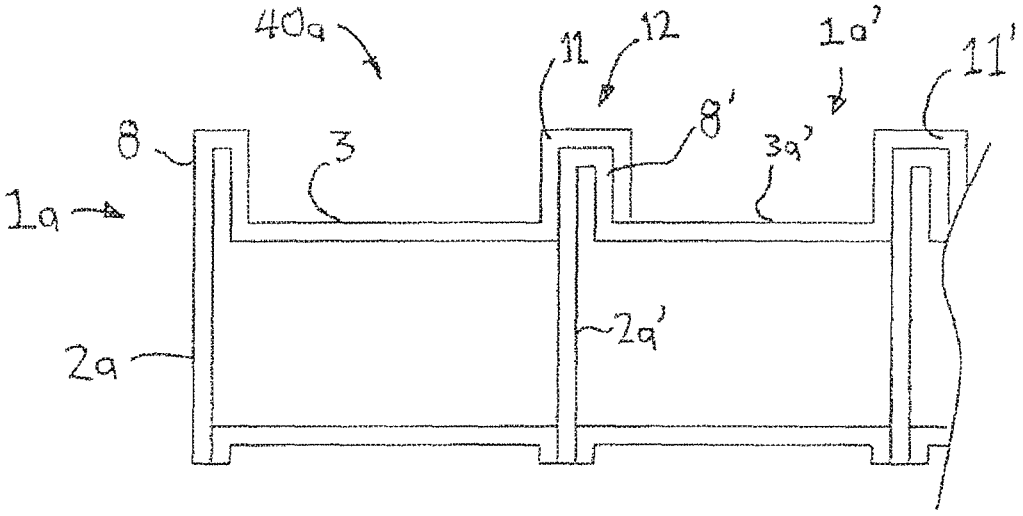
FIG. 4 is a sectional view showing a deck assembly comprising two joists of FIG. 2.

The joists 1*a* are arranged, as can be seen at FIG. 4 to define a deck assembly 40*a*. In this embodiment each joist 1*a*,1*a*' is interconnected in nested engagement by intercalating the parapet 8 with the rib 11 located on adjacent joists 1, 1'. Such intercalation of male and female portions results in an upstanding seam 12 which can be folded and swaged (see FIG. 5) as an alternative to individual mechanical fasteners.

Figure 5A:
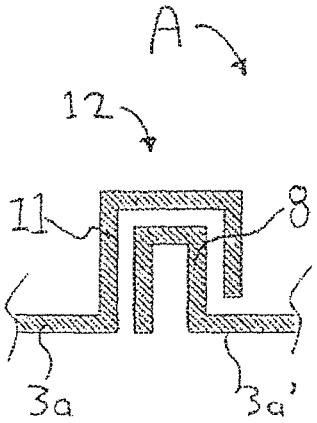
FIG. 5A to 5C show a sequence of a closure of a seam formed by intercalating male and female portions from adjacent joists.
Figure 5B:
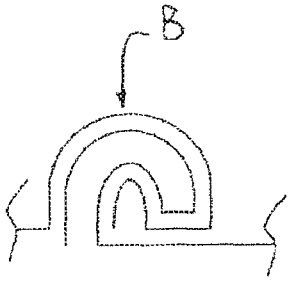
Figure 5C:
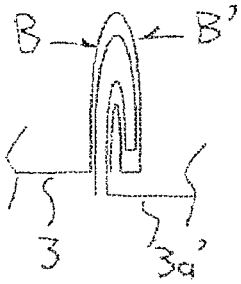

FIGS. 5A to 5C show a sequence of a closure of the seam 12. FIG. 5A shows the open seam 12 formed by intercalating adjacent joists. A pneumatic seam closing apparatus (not shown) is used to fold the open seam in the direction of arrow A (FIG. 5B). This results in a closed seam 13 that is impervious to the environment external of the deck assembly and inclement weather.

FIG. 5C shows that the closed seam 13 of FIG. 6B can be swaged to reduce material thickness at the closed seam. The closed seam 13 has been swaged in the direction of arrows B and B'.

Figure 6:
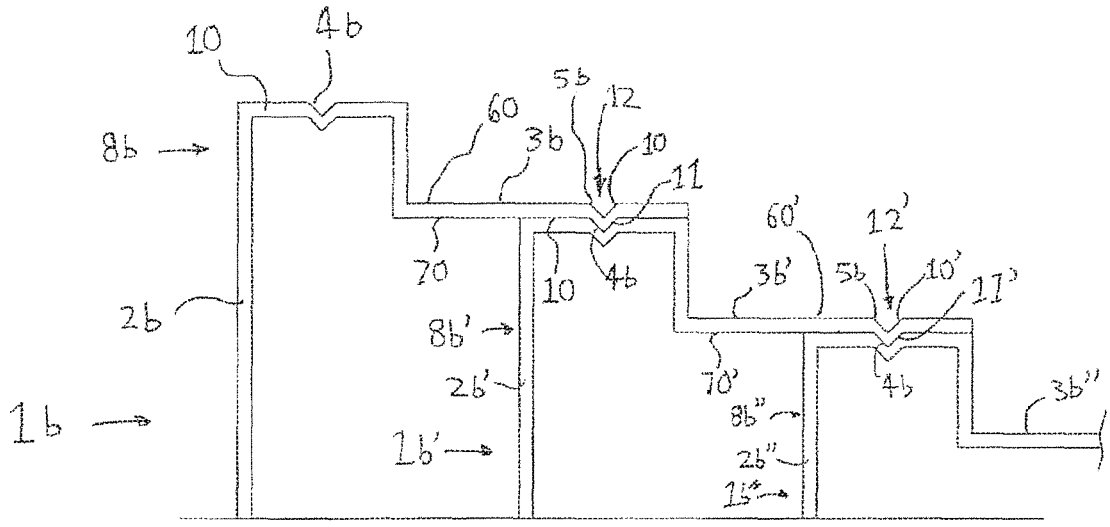
FIG. 6 is a sectional view of a deck assembly in a stair configuration.

As may be seen in FIG. 6 where a suffix b is added for clarity, a plurality of joists 1*b*, 1*b*', 1*b*" may be assembled in a stair-like configuration. Each joist 1*b*, 1*b*', 1*b*" has an exaggerated web portion 2*b*, 2*b*', 2*b*" which is bent back on itself to form a parapet 8*b*, 8*b*', 8*b*". The deck portion 3*b*, 3*b*', 3*b*" of the joists 1*b* extends substantially perpendicularly outwardly from the upstanding portions 2*b*, 2*b*', 2*b*". The parapet 8*b*, 8*b*', 8*b*" projects above the deck portion 3*b*, 3*b*', 3*b*" to form the individual steps of the stair-like deck assembly 40*b*.

The deck 3*b* of the joists 1*b*, 1*b*', 1*b*" are provided with V-shaped recesses 5*b* as shown in the embodiment of FIG. 1. Similarly, the upper end face 10 of the parapet 8*b* has a V-shaped recess 4*b* formed to receive the recess 5*b* of the deck 3*b*. The height of the web 2*b* will vary for each step and bridges may be incorporated between the webs to interconnect them if so required. The joists 1 are connected by fasteners as described above with respect to FIG. 1.

Figure 7:
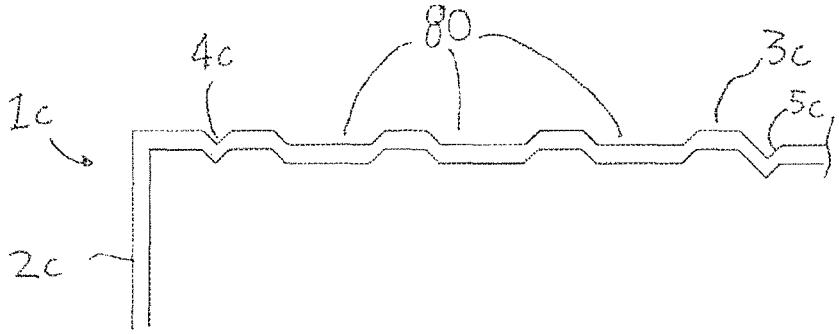
FIG. 7 shows a joist with reinforcing ribs.

FIG. 7 shows a joist 1*c* with reinforcing ribs in the deck portion 3*c*. The joist 1*c* comprises an upstanding portion 2*c* and a platform portion 3*c* extending substantially perpendicularly outwardly from the upstanding portion 2*c*. The platform portion 3*c* is provided with a plurality of castellations 80. The castellations 80 provide additional structural rigidity to the deck 3*c* to prevent twisting of the platform 40*c*. The castellations 80 are arranged parallel to the longitudinal axis of the joist portion 3*c*, however, the ribs 80 can be positioned perpendicular to longitudinal axis depending on the application the deck assembly is being used for.

It will be noted that the V-shaped recesses 4*c*, 5*c* are provided in the deck portion 3*c* adjacent the web 2*c* and distal edge of the deck 3*c*. The castellations 80 are located between recesses 4.5 to permit the units 1*c* to be joined side by side.

Figure 8:
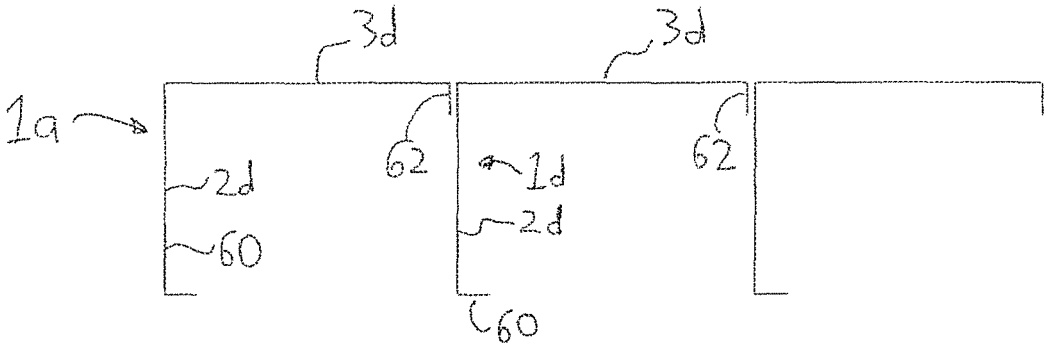
FIG. 8 is a sectional view of a further embodiment of joist.

A further embodiment is shown in FIG. 8 in which like reference numerals will be used to denote like component with a suffix d added for clarity. In the embodiment of FIG. 8, each of the joists has a flange 60, 62 formed at the free edge of the web portion 2*d* and the deck portion 3*d* respectively. To form a continuous deck, the flange 62 is butted against the web of the adjacent unit 1*d* with the decks aligned. The flange 62 may then be secured to the adjacent web 2*a* as described above. The flange 60 at the lower end of the web 2*d* enhances the bending stiffness of the joist and provides a bearing surface when the deck assembly is located on a support.

Figure 9:
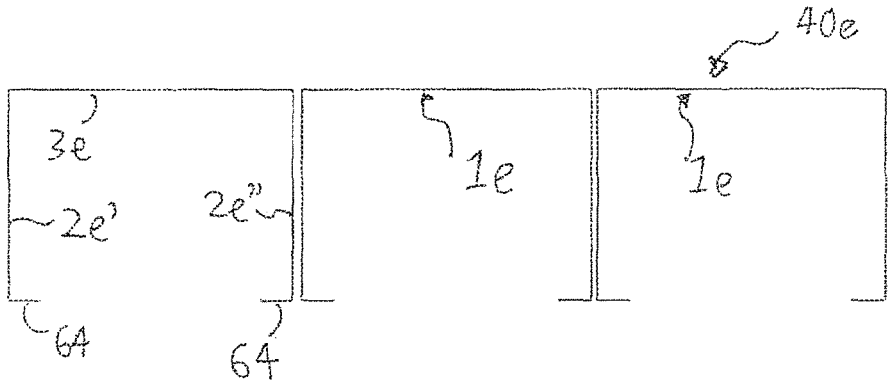
FIG. 9 is a sectional view of a yet further embodiment of joist.

A similar arrangement is shown in FIG. 9 in which a pair of webs 2*e*', 2*e*" extend perpendicularly from opposite edges of deck 3*e*. Each of the webs 2*e*', 2*e*" terminates in a flange 64. The deck assembly 40*e* is assembled by abutting the webs 2*e*', 2*e*" of adjacent joists 1*e* against one another and securing the webs 2*e*', 2*e*" by mechanical fasteners or the like.

Figure 10:
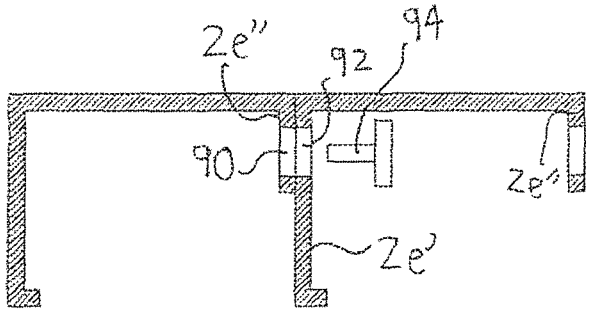
FIG. 10 is an enlarged view of a portion of the joist shown in FIG. 8.
Figure 11:
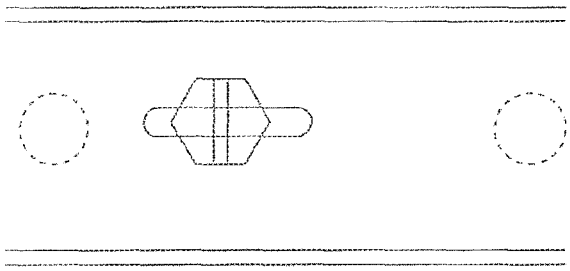
FIG. 11 is a view on the line XI-XI of FIG. 10.

The attachment of the adjacent units to one another is shown in greater detail in FIGS. 10 and 11, as applied to the embodiment shown in FIG. 8. It will be appreciated however that a similar arrangement may be utilized in each of the embodiments described above. Referring therefore to FIGS. 10 and 11, a hole 90 is punched into the web 2*e*" and elongate slot 92 punched into the web 2*e*'. The hole 90 and slot 92 are aligned permitting limited fore and aft adjustment between the two joists. A fastener 94 is inserted through the slot and engages with the hole 90. The fastener 94 is preferably self tapping so as to cut the thread on the hole 90 and pull the web 2*e*" up to and in abutment with the web 2*e*'.

To assist alignment of the units 1, each of the opposed portions of the joists 1, either the web portions or the deck portions may be formed with a registrar such as a witnessed deformations or dimples 96 that provide for registration of one unit against another. Such an arrangement assists in the rapid assembly and alignment of the deck assembly.

Figure 12:
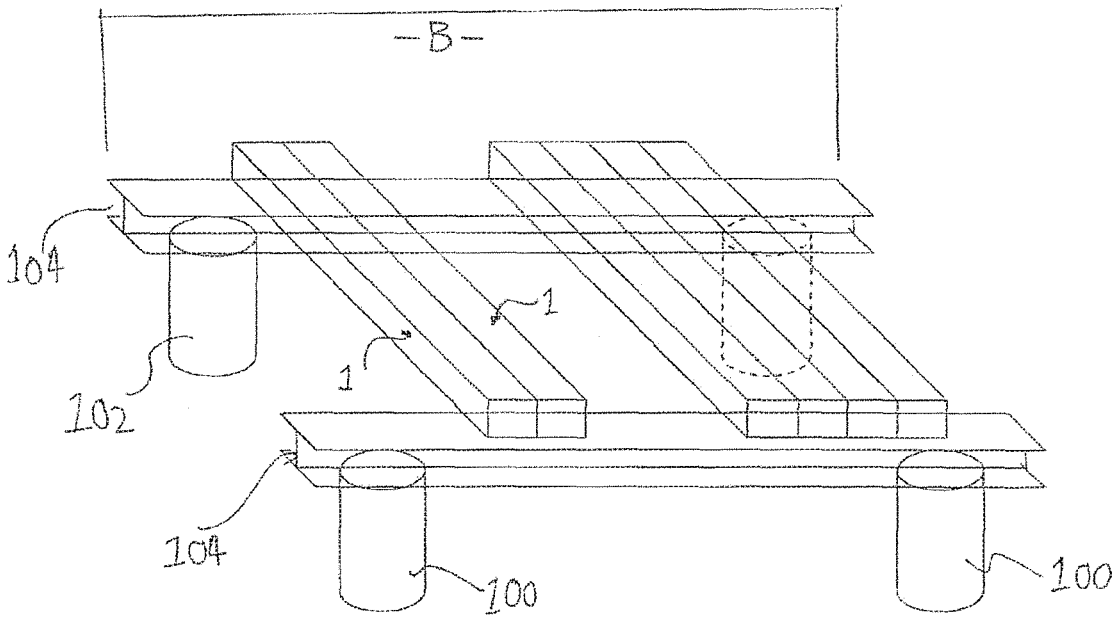
FIG. 12 is a perspective view of a deck assemble utilizing the joists shown in FIGS. 1 to 11.

In each of the embodiments described above, it will be noted that the joists may be assembled to provide a continuous deck surface whilst providing integral support for that surface in the form of the webs. The deck assembly 40 may be used in a variety of environments and under different conditions. As illustrated in FIG. 12, the deck assembly 40 may be utilized as an elevated deck in residential or commercial environments. Referring therefore to FIG. 12, a pair of posts 100, 102 support a beam 104 that extends generally parallel to the face of a building B. The beam 104 is dimensioned to support the load imposed upon the deck in the normal use and in accordance with the relevant building standards. It will also be appreciated that whilst a steel beam is preferred, a wooden beam may be used with the span adjusted accordingly.

The joists 1 are then assembled side by side to run perpendicular to the beams 104. The joists 1 are connected to one another through the fastening and enhanced rigidity provided by the bridges 50 that may extend either continuously along the length of the joist 1 or extend intermittently along the length.

The webs 2 of the joists 1 are secured to the beams 104 by clips, screws or other fasteners to secure the joists.

Depending upon the cross section of the joists 1 that is utilized, it may be necessary to support the distal edge of the final unit with an additional web that may be fastened to the distal edge of the joist 1 and may be provided with an inter-engaging formation.

During assembly of the deck assembly 40, each of the joists is relatively easy to handle due to the light weight construction. The joists 40 may be aligned and interconnected through the use of the inter-engaging formations and secured to one another by fasteners, either mechanical or permanent. Where necessary, the length of the units 1 may be extended by joining two joists end to end with an overlap between the ends of the joists over a beam.

With the deck assembly 40 assembled, it is possible to utilize a variety of structural and non-structural finishes providing increased flexibility in achieving the desired aesthetics, since the finishes are not required to provide structural support to the deck assembly. The deck assembly 40 may, for example, support tile, stone, slate, concrete, pavers, wood tiles or the like. These may be free floating on the deck surface or may be attached with adhesive or screws or the like.

Figure 13:
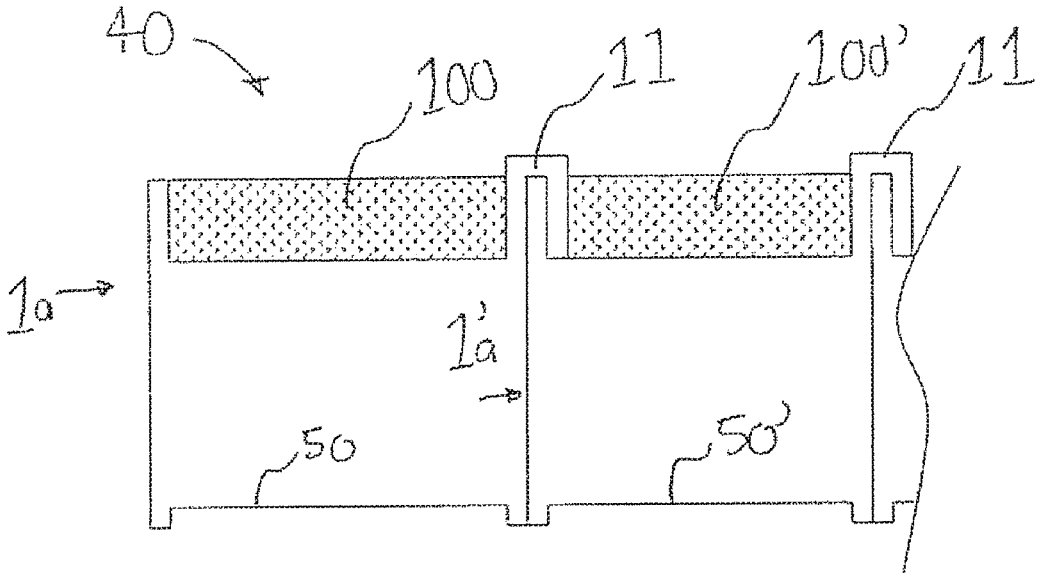
FIG. 13 shows a deck assembly in accordance with the present invention in a specialty floor configuration.

As may be seen in FIG. 13, the deck assembly 40 using joists 1*a* as shown in FIG. 3 provides a recessed area into which cement or concrete or other filler or substrate 100, 100' can be poured. This is particularly useful when a raised floor is required in, for example, special equipment rooms. The cement or other filler serves to provide a durable surface and also provides structural support to the deck assembly by preventing twisting of the platform structure. The deck assembly is also provided with lower chord bridging 50, 50' to further support the deck assembly 40.

Although the joists have been described above in the context of building a deck assembly, it will be appreciated that a similar system may be used to provide a flat roof of a building or as an inclined roof with the rafters integrally formed by the webs. The deck assembly may also be used as a self supporting structural vertical wall.

Although described principally in a construction environment, the product may also be used in other horizontal applications, such as the bed of a trailer, or in a vertical application such as a billboard.

In each embodiment, the webs 2 may be formed with predefined apertures to accommodate services being provided beneath the deck 3 and to minimize the cutting necessary at final installation. This enables the applied finish to be maintained after installation and inhibit corrosion.

Figure 14:
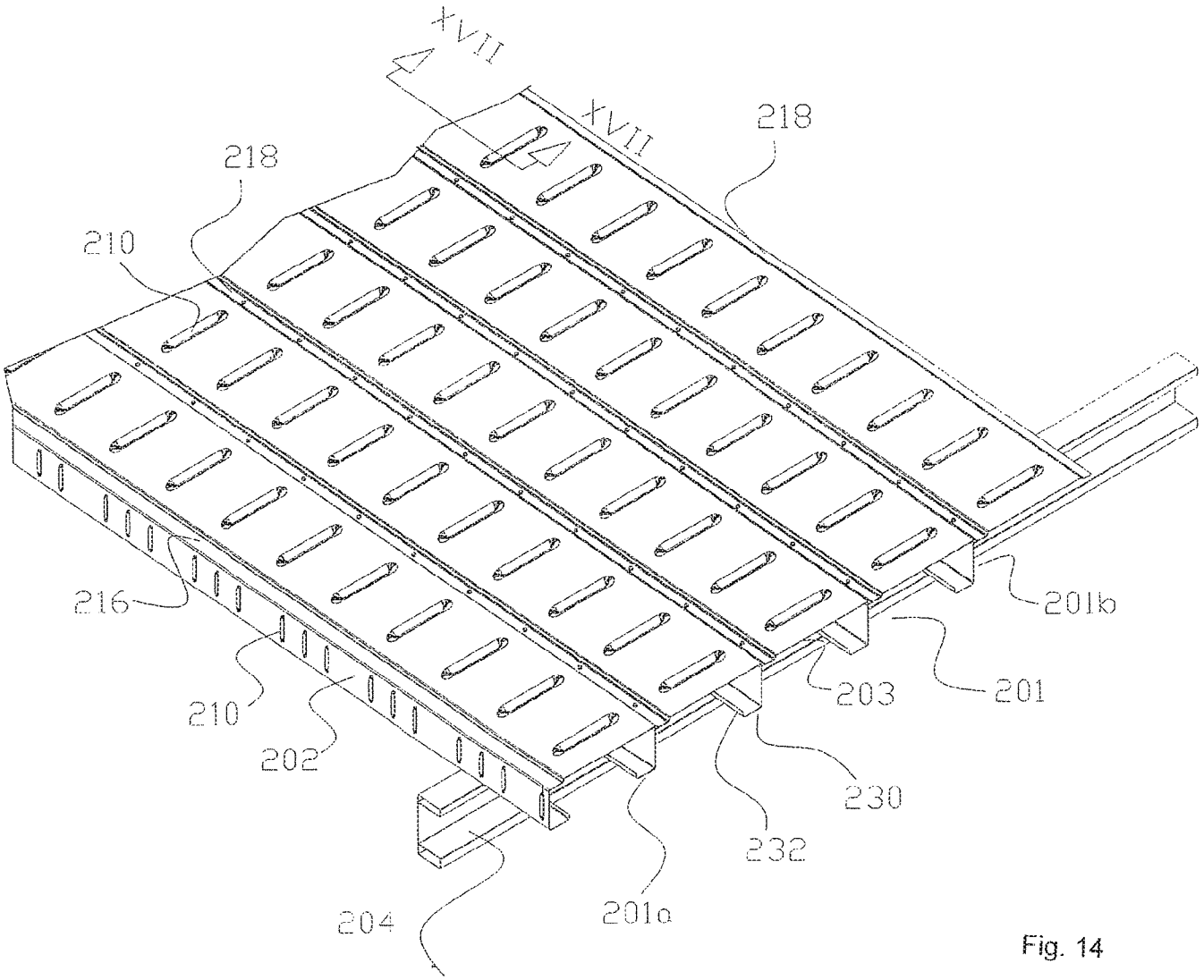
FIG. 14 is a perspective view of a further embodiment of deck assembly, similar to that of FIG. 12.

The decking assembly 200 shown in FIG. 14 utilises an alternative profile of joists that are particularly suitable for providing a deck assembly on conventional substructure to support a paved area. The deck assembly 200 is formed from joists 201 that are arranged side by side and connected to one another as generally shown in the previous embodiments. The joists 201 run generally perpendicular to the support beams 204 and are secured to the beams for stability.

Figure 15:
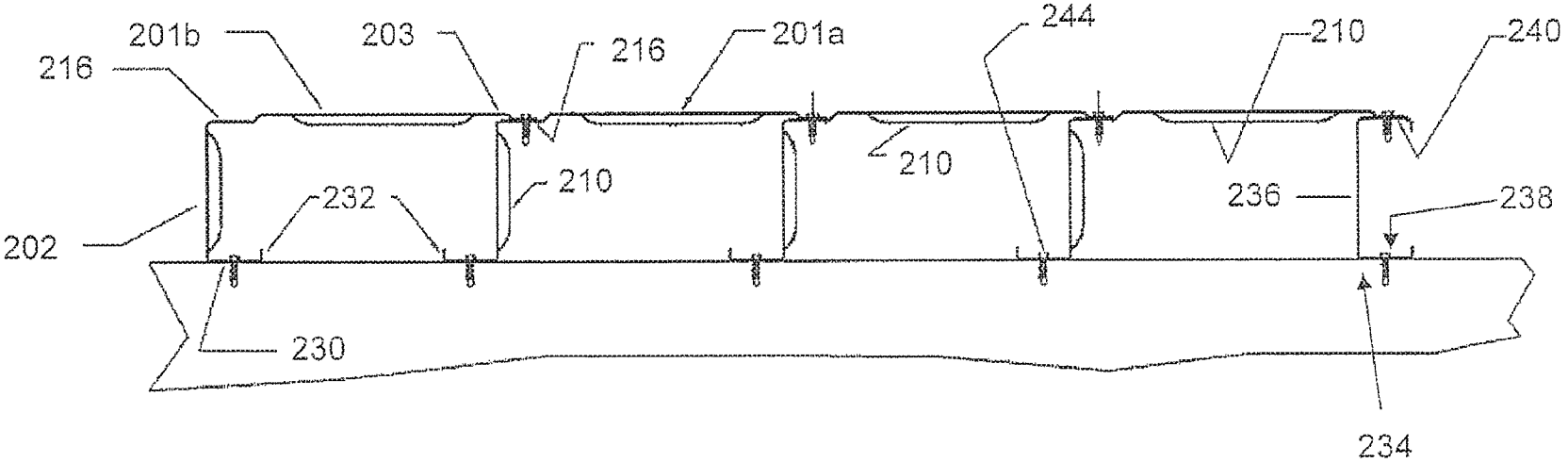
FIG. 15 is a section on the line XV-XV of FIG. 14.
Figure 18:
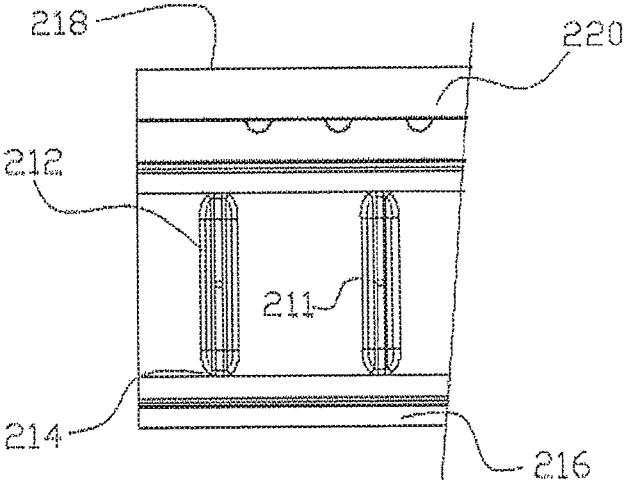
FIG. 18 is a plan view of the deck assembly of FIG. 14 on an enlarged scale.
Figure 17:
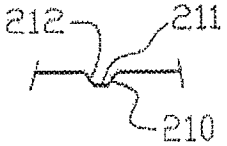
FIG. 17 is a section on the line XVII-XVII
Figure 16:
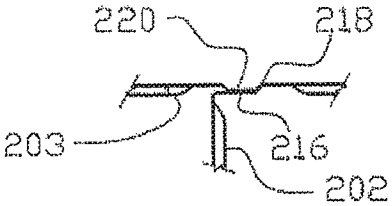
FIG. 16 is an enlarged view of FIG. 15 showing in greater detail the connection between adjacent joists

As can best be seen in FIG. 15, two different profiles of joist are used in the deck assembly of FIG. 14, a main joist indicated at 201*a* and an end joist indicated at 201*b*. Both joists 201 have a web portion 202 to extend generally vertically and a deck portion 203 that extends generally horizontally from the web portion 202 for engagement with an adjacent joist. Each of the web portions and deck portions has inwardly directed ribs, 210, formed at spaced intervals along the respective portions. Each of the ribs 210 extends laterally relative to the length of the joist and has a generally part circular cross section, indicated at 212, as seen in FIG. 17, and a part spherical end section indicated at 214, as seen in FIG. 18. The ribs 210 thus merge smoothly with the generally planar deck portion and web portion whilst providing local stiffening. A drainage hole 211 is provided in each of the ribs 210 of a deck portion to prevent accumulation of water.

At the intersection of the deck portion 203 and web portion 202, the deck portion 203 is jogged inwardly to provide an offset shelf section 216 running longitudinally along the length of the joist 201. The shelf section 216 is set below the upper surface of the deck portion 203 to provide support for the distal edge 218 of the deck portion 203 of an adjacent joist 201.

As can be seen in FIG. 15, the distal edge 218 of the deck portion 203 is itself jogged to provide an offset tail 220 along the distal edge 218. The offset of the shelf section 216 is greater than the offset of the tail 220 by the thickness of the material used in the deck portion 203, so that when the tail 220 rests on the shelf, the deck portions 203 of adjacent joists 201 are level with one another. The shelf section 216 is also wider than the tail 220 to accommodate relative adjustment between the joists 201, as described more fully below.

The lower edge of the web portion 202 terminates in a flange 230 that extends generally perpendicular to the web portion 202. In the case of the main joist 210*a*, the flange 230 extends outwardly, i.e. in the opposite direction to the deck portion 203, whereas in the end joist 201*b*, the flange 230 extends inwardly in the same direction as the deck portion 203. The flange 230 terminates in an upstanding return 232 to impart stiffness to the flange. Small holes may be located at intervals longitudinally along the flange 230 to provide for adequate drainage of accumulated or shedding water.

To assemble the joists 210 on the beams to form a deck assembly 200, an edge strip 234 is first secured to the beams at one side. The edge strip 234 has a vertical web 236 with a flange 238 at its lower edge and a ledge 240 at its upper edge. The spacing between the flange 238 and ledge 240 corresponds to the distance from the underside of the flange 230 to the underside of the tail 220 of a joist 201. If a particulate material such as sand or gravel is to be placed on the deck assembly 200, the edge strip 234 is formed with an upstanding wall 242 beyond the ledge 240. This is integrally formed by folding the web 236 back on itself. Fasteners 244 are inserted through the flange 238 of the edge strip 234 in to the beams to hold the edge strip 234 in place. The fasteners 244 may be self piercing, or holes may be formed in the flange 238 at suitable increments to allow the fastener 244 to be inserted.

With the edge strip 234 in situ, a main joist 201*a* is positioned with the tail 220 resting on the ledge 240. The tail 220 may be secured to the ledge 240 with fasteners 246 and the joist 201*a* is secured to the beam by further fasteners 244 passing through the flange 230. The out-turned flange 230 of the main joist 201*a* facilitates the insertion of the fasteners 244 as the flange 230 is exposed and allows the fasteners 244 to be easily inserted. It will also be appreciated that the offset of the tail 200 from the deck portion 203 allows the fasteners 246 used to secure it to the ledge 240 to be flush with or below the general level of the deck portion 203.

The next joist 201 is then positioned with its tail 220 resting on the shelf section 216 of the preceding joist 201. The wider shelf section 216 allows the tail 220 to be adjusted along the length of the joist to maintain the required alignment between the joists 201 and provides for flexibility of alignment and pitch during assembly of the joists 201 to accommodate variability and dimensional inaccuracies of structures in an as-built condition. Normally, such an alignment is parallel to one another, but in some circumstances the joists 201 may be fanned relative to each other to provide an arcuate surface in plan. With the joists positioned, fasteners 246 are inserted through the tail 220 and shelf section 216, and fasteners 244 inserted through the flange 230 in to the supporting beam.

Further main joists 201*a* are connected side by side in a similar manner to complete the required extent of the deck assembly. At each connection, the tail 220 is supported on the shelf section 216 of the preceding joist and secured with fasteners 246.

At the opposite side of the deck assembly 200, an end joist 201*b* is used so that the flange 230 is directed inwardly relative to the deck portion 203 and a flush end face is maintained. Access to the interior of the flange 230 is available to place fasteners 244, or alternatively the fasteners may be inserted diagonally through the web portion 202 and flange 230. If a retaining edge is required, an angle piece 248 may be secured to the shelf section 216.

With the deck assembly 200 complete, the surface may be clad with the requisite covering. The deck assembly provides a modular structural diaphragm that can be rapidly and securely placed in new construction or over an existing substructure to provide a generally continuous structural diaphragm to support a variety of coverings such as architectural pavers. The continuous structural diaphragm may be fabricated of different material. The selection of material thickness, and other dimensions is dependent on achieving minimum structural performance for static and dynamic loading, deflection, and flexural strength of the architectural pavements.

The modular structural diaphragm material may be selected from a flat-rolled steel having a corrosion resistant coating. Where the modular structural diaphragm material is steel, it should have material yield strength from at least 33 ksi, preferably at least 50 ksi; and substrate having a thickness of between 1 mm and 3 mm with 1.42 mm to 2 mm preferred. The integral joist element and integral deck stiffeners may be designed for maximum section modulus at a given material thickness and material properties for steel to achieve design criteria for longitudinal deflection.

The material thickness of each modular element remains constant to within normal production tolerances. The particular design of the joist, web stiffener, the transverse stiffener, and deck element are selected to satisfy structural conditions due to static and dynamic loading in accordance with local building regulations, including the maximum vertical displacement across the particular element; and maximum permissible slopes, moments, stresses, and shear forces for the particular element. In addition, the layout of the joist, the transverse stiffener, and deck element relative to each other may be designed to limit the maximum permissible span of any individual paver over any single element. Typically, the maximum displacement of any element is limited to at most L/360, and preferably L/480, where L is the length of the span of the particular joist between supports.

Where individual pavers are used, an underlayment may be positioned between the metal diaphragm and the pavers to assist with cushioning, and water drainage. The thin pavers may be either placed in a floating arrangement on top of the structural metal diaphragm with or without the underlayment, or adhered to the metal diaphragm with a suitable mortar or adhesive.

In a preferred embodiment, floating architectural pavers have a minimum weight of 15 pounds per square foot, a minimum flexural strength of 580 pounds per square inch ("psi) when tested per ASTM C-293, and minimum breaking force of 1125 pounds. Depending on the mass density of the pavers, such pavers with these attributes would have a minimum thickness of 1.25 inches per square foot for concrete pavers, and 1.00 inch per square foot for most dimension stone tiles.

As the thickness of the paver is decreased, then there is a requirement for increased flexural strength of the paver to prevent cracking and breaking, as well as the use in combination with adhesives or mortar to prevent wind uplift. The use of an underlayment or adhesive is based on the dimensions of the paver, paver weight per square foot, flexural strength of the paver to support loading and prevent cracking, and applicable building codes and regulations (including standards relating to wind uplift forces). If preferred, pavers with integral "feet" may be used to allow water to pass beneath without obstruction.

A suitable form of main joist 201*a* intended for residential installations and conforming to the Ontario Building Code has an overall height of the web portion 202 of 5½ (5.5) inches and an overall width of the deck portion of 11¾ (11.75) inches. The flange 230 has a width of 1.9 inches. The shelf section 216 has a width of 1⅝ (1.625) inches and that of the tail 220 9/16 inch. The ribs 210 in the deck portion have a length along the major access of the rib 210 of 7 inches, starting 2 inches from the intersection of the web portion and deck portion, and a minimum depth of ½ inch to provide a width of 1 inch. The ribs 210 in the web portion 202 are centred on the web portion and have a length of 4.5 inches and a minimum depth of 0.460 inches for a width of 0.92 inches. The ribs 210 repeat at intervals of 3 inches.

The material conforms to ASTM A653 and has a nominal substrate thickness of 0.056 inches. The offset of the shelf section from the main deck portion is ¼ inch, and that of the tail 220 correspondingly reduced by the thickness of the material.

This configuration of joist 201 is sufficient to support a covering of pavers when placed on beams at eight-foot centres.

More generally, the preferred dimensions provide for a continuous offset of the shelf section to provide a 0.25" recess beneath the common surface to accommodate most screw fastener heads. The shelf section is from 1 inch to 2 inches, preferably 1.625 inches. The tail 220 forming the free edge may be as large 1 inch to 2 inches, preferably 1 inch. In nested arrangement, the tail may be laterally adjusted up to 1-inch on each end of a mating shelf section of an adjacent joist to accommodate variations of dimensions of as-built structures. This avoids the tedious work of precisely fitting the joists 201 to conform with as-built structures, such as a perimeter wall.

Figure 19:
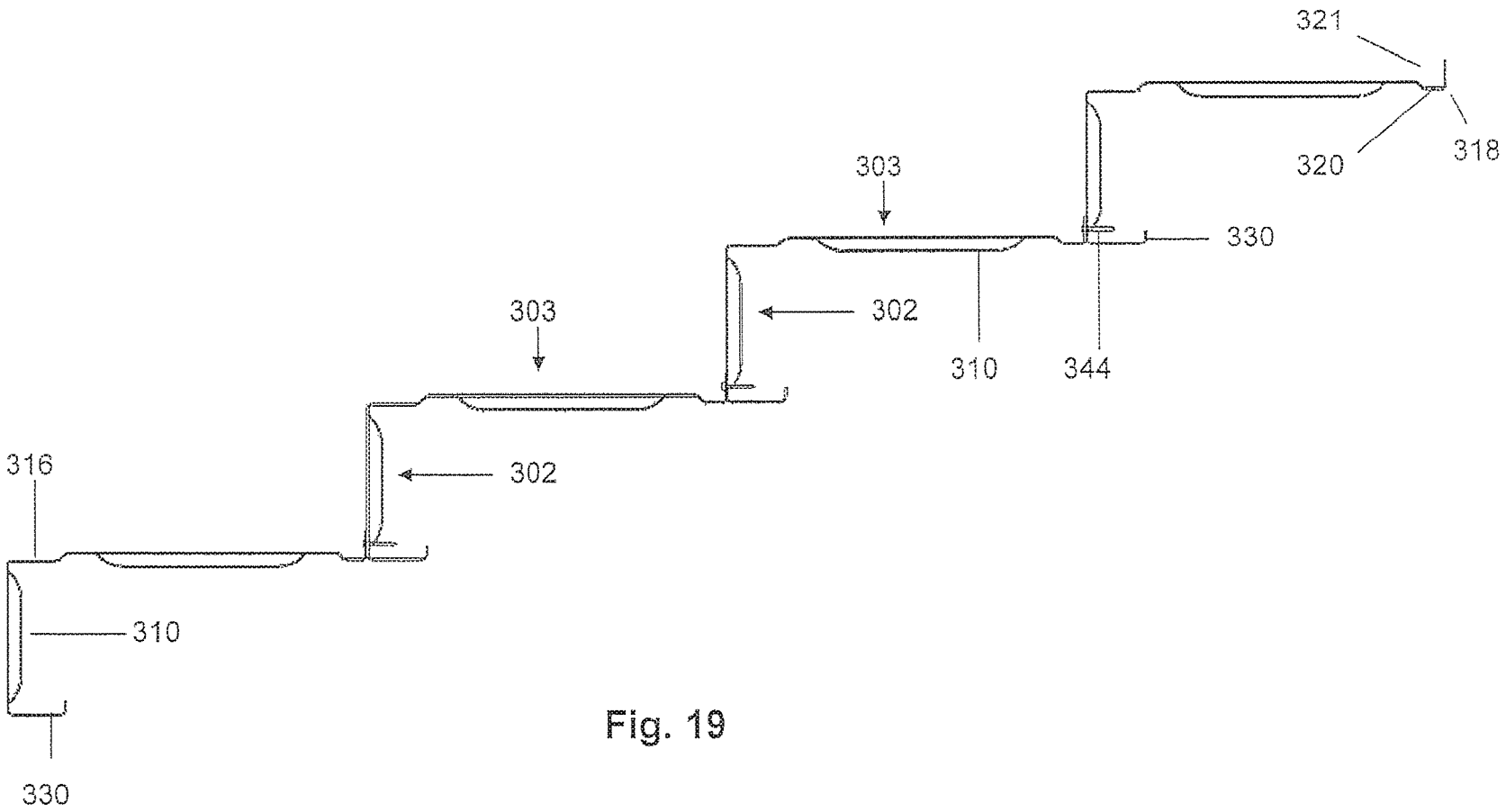
FIG. 19 is a side elevation of a stair assembly
Figure 20:
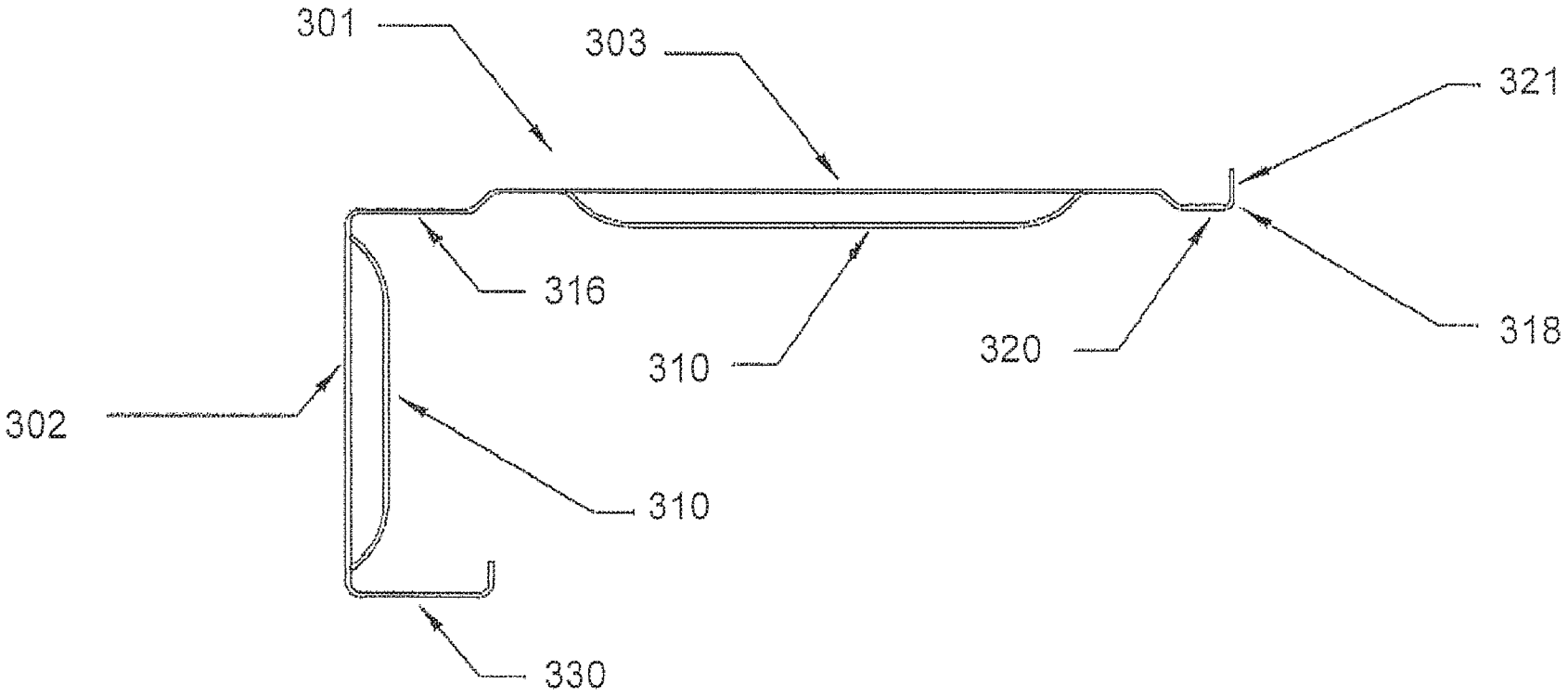
FIG. 20 is an enlarged view of a section of the stair assembly of FIG. 19.
Figure 21:
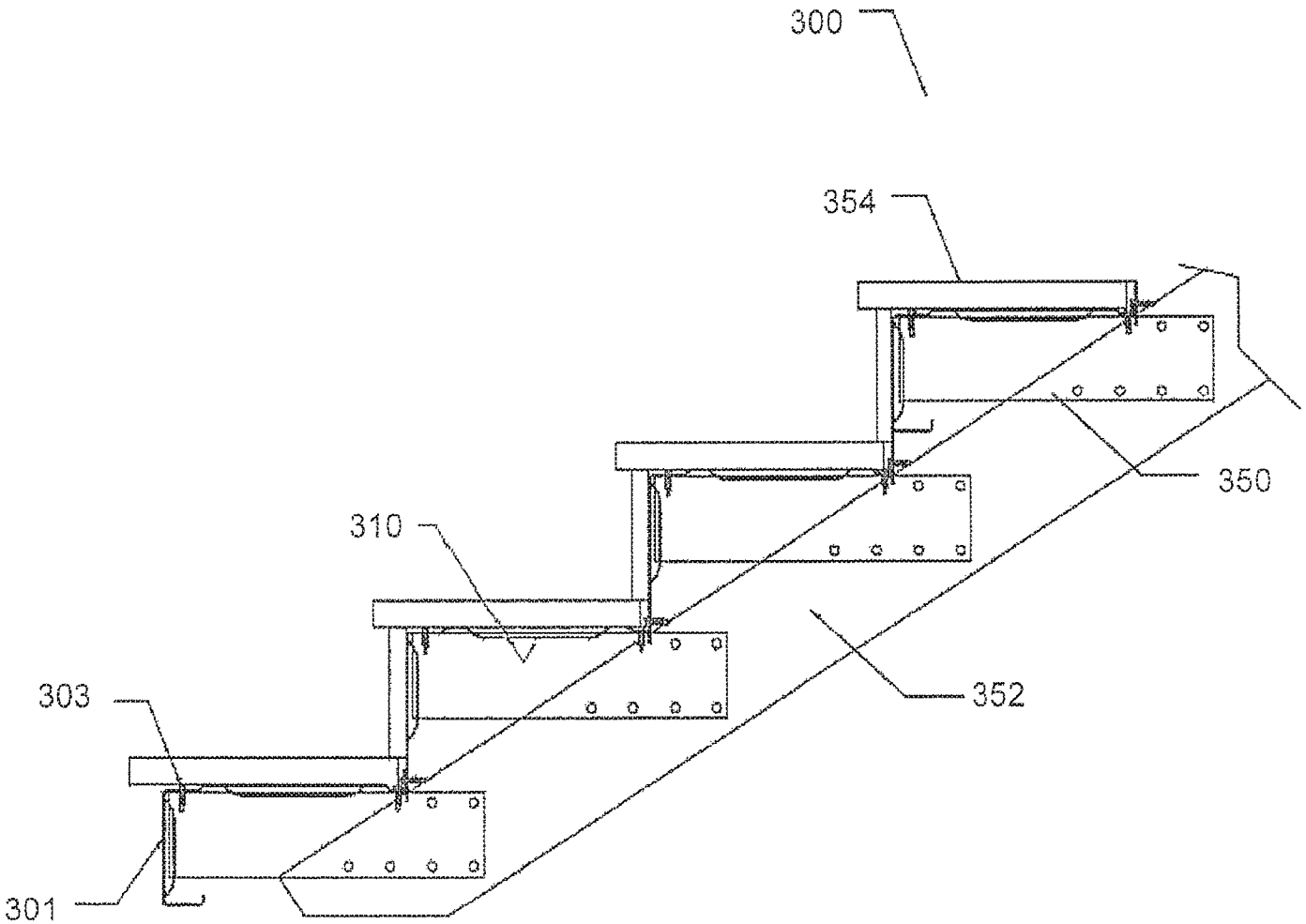
FIG. 21 is a side elevation of a stairway using the assembly of FIG. 19.
Figure 22:
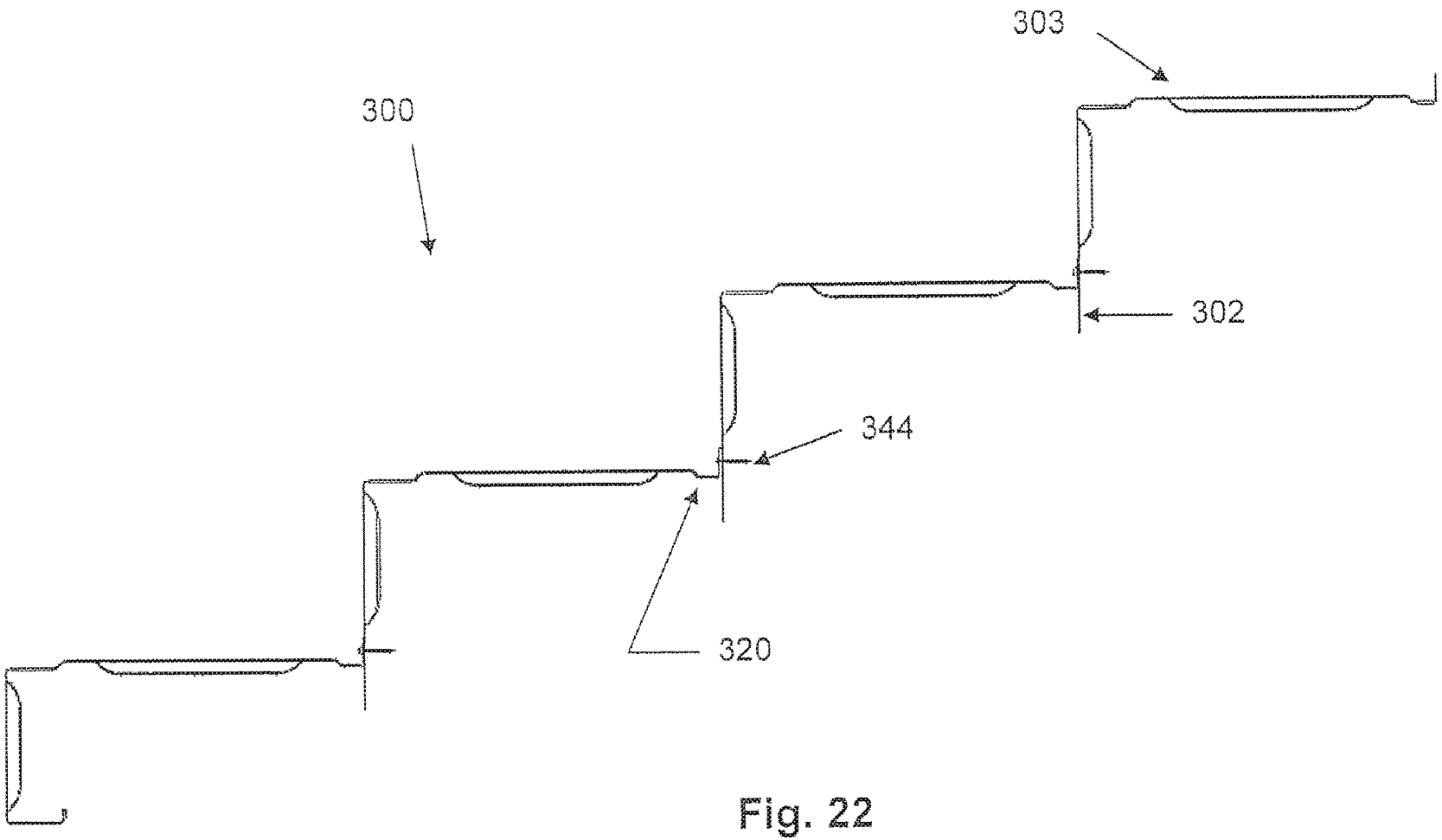
FIG. 22 is a side elevation similar to FIG. 19 of an alternative embodiment of stair assembly.

The configuration of joist 201 may also be adapted to provide stairs, as illustrated in FIGS. 19 to 21. Traditional wood stairs in a straight configuration from one floor to the next requires around 280 saw cuts and can easily take a single highly skilled carpenter 4-6 hours to complete. Even existing prefab stairs require skilled trades to complete the installation of the pre-fab stair in the field.

In building a set of stairs, the homeowner has limited choices with respect to materials and dimensions. Prefabricated concrete stairs are limited in width, rise and run due to fixed tooling and manufacturing methods, and are susceptible to cracking during transport and installation. Prefabricated and site-built concrete stairs are expensive and are susceptible to spalling and wear from environmental factors. Prefabricated steel stairs are also expensive and limited in width, rise and run dimensions due to fixed tooling and manufacturing methods, and require specialised tools and skills to install.

As shown in FIGS. 19 to 21, use of the joist arrangement provides a modular system that allows the stair system to be assembled quickly and easily. Referring to FIGS. 19 to 20, a stair assembly 300 is formed from a series of joists 301, connected to one another. The profile of each joist 301 is similar to that of the deck assembly 200 described above, with a web portion 302 and a deck or tread portion 303. The tread portion 303 has a shelf structure 316 formed at the intersection of the web portion 302 and tread portion 303 and a tail 320 on the distal edge 318. Ribs 310 are formed in each of the web portion and tread portion having a similar configuration to those used in the joists 201. A flange 330 is inturned, as in the end joist 201*b*.

As best seen in FIG. 20, the tail 320 has an upturned flange 321 that extends at right angles to the tail 320 along the length of the joists 301. The flange 321 serves as an attachment surface to connect adjacent joists 301 in stepped manner.

As can be seen in FIG. 19, the flange 321 of the lower joist 301 is connected to the lower edge of the web portion 302 by fasteners 344. The vertical face of the flange 321 provides for connection of the two joists while at the same time permitting limited vertical adjustment of the exposed face of the web portion 302 to determine the rise of the steps preferably from between 5.5 to 7.5 inches. Similar connections are made with successive joists until the required number of treads is obtained. Thereafter, as shown in FIG. 21, the stair assembly is fastened via side plates 350 to stringers 352 and finish surfaces 354 can be attached to the tread portions 303. The stringers may be made of a material and dimensions suitable for the structural performance desired such as with wood or metal, and are preferably made from cold formed steel tubing that has cross section dimensions of 2 inches by 6 inches and is 0.080 inches thick and coated to prevent or retard corrosion, such as with zinc, aluminum zinc or organic coatings. Preferably a zinc coating is applied using the hot dipped galvanized process. Galvanised zinc coating thickness may vary depending on location in use, but is generally within the range of 0.6-2.35 ounces per square foot applied (i.e. G60 to G235), and preferably 0.6 ounces per square foot, (i.e. G60).

The joists 301 are preferably made from cold formed steel having a thickness of between 1 mm and 3 mm with 1.42 mm to 2 mm preferred and coated to prevent or retard corrosion, such as with zinc, aluminum zinc or organic coatings. Preferably a zinc coating is applied using the hot dipped galvanized process. Galvanised zinc coating thickness may vary depending on location in use, but is generally within the range of 0.6-2.35 ounces per square foot applied (i.e. G60 to G235), (i.e. G60 to G235), and preferably 0.9 ounces per square foot, (i.e. G90).

This stair assembly 300 is secured using galvanized steel brackets and fasteners to at least two stair stringers preferably made from galvanized steel. The number of stair stringers required is dependent on loading conditions to be satisfied and the width selection of the stairs. The actual spacing between stringers is variable, but is preferably between 30-48 inches apart. The bracket may be made from galvanized steel in standard C-sections known and available in the art preferably with dimensions of 2 inches by 4 inches and is 0.080 inches thick.

The ribs 310 provide increased structure and stability to the stair assembly, depending on loading conditions. The ribs are generally semi-circular in cross section for improved rigidity and are formed contiguously into the web portion 302 to increase the resistance to deflections, web crippling strength of the section and increase the lateral-torsional strength. The ribs 310 also provides a means to balance material flow between the first web and the lateral ribbing of the deck or tread portion during manufacturing to control acceptable flatness and camber of the deck or tread portion and straightness of the first web.

The continuous longitudinal shelf sections 316 and 320 are recessed into the plane of the tread portion to allow for fastening to brackets while maintaining a singe horizontal datum surface on which to apply stone pavers, tiles, or the like on a common datum surface and minimize rocking, splitting or cracking of stones or pavers due to an uneven surface or the projection of the fastener heads above the datum surface.

The shelf sections also provide increased sectional rigidity which contributes to limit vertical deflections and resist crippling under loading conditions, and achieves a structural efficiency that is not achievable with a single piece structural element of similar thickness.

An alternative arrangement is shown in FIG. 21 where the web portion 302 is extended and formed without the flange 310. The vertical adjustability is therefore increased whilst still providing attachment surfaces between the adjacent joists. Knockouts are generally provided in the web portion to allow adjustability without interference with the stringers.

To achieve a stair with an enhanced variable run capability, the joist 301 may be manufactured without the vertical flange 301 and the tail 320 increased. Multiple joists may be combined to achieve a large run dimension in the stair tread. The tail 320 provides for lateral adjustment to accommodate variability and dimensional inaccuracies of structures in an as-built condition. This arrangement also allows for variable pitch nesting to create a curved stair surface.

Figure 23:
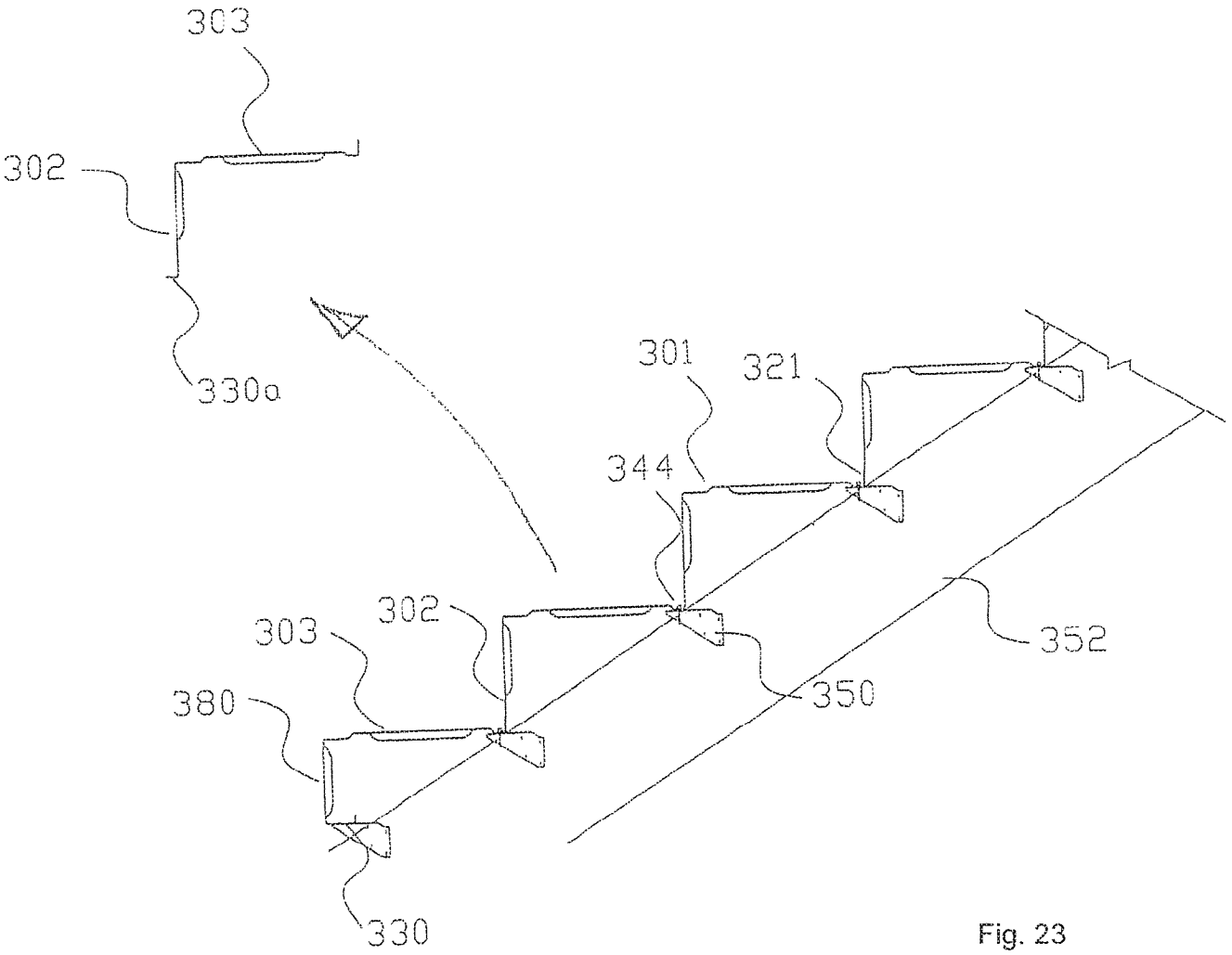
FIG. 23 is a side elevation similar to FIG. 19 of a further alternative.
Figure 24:
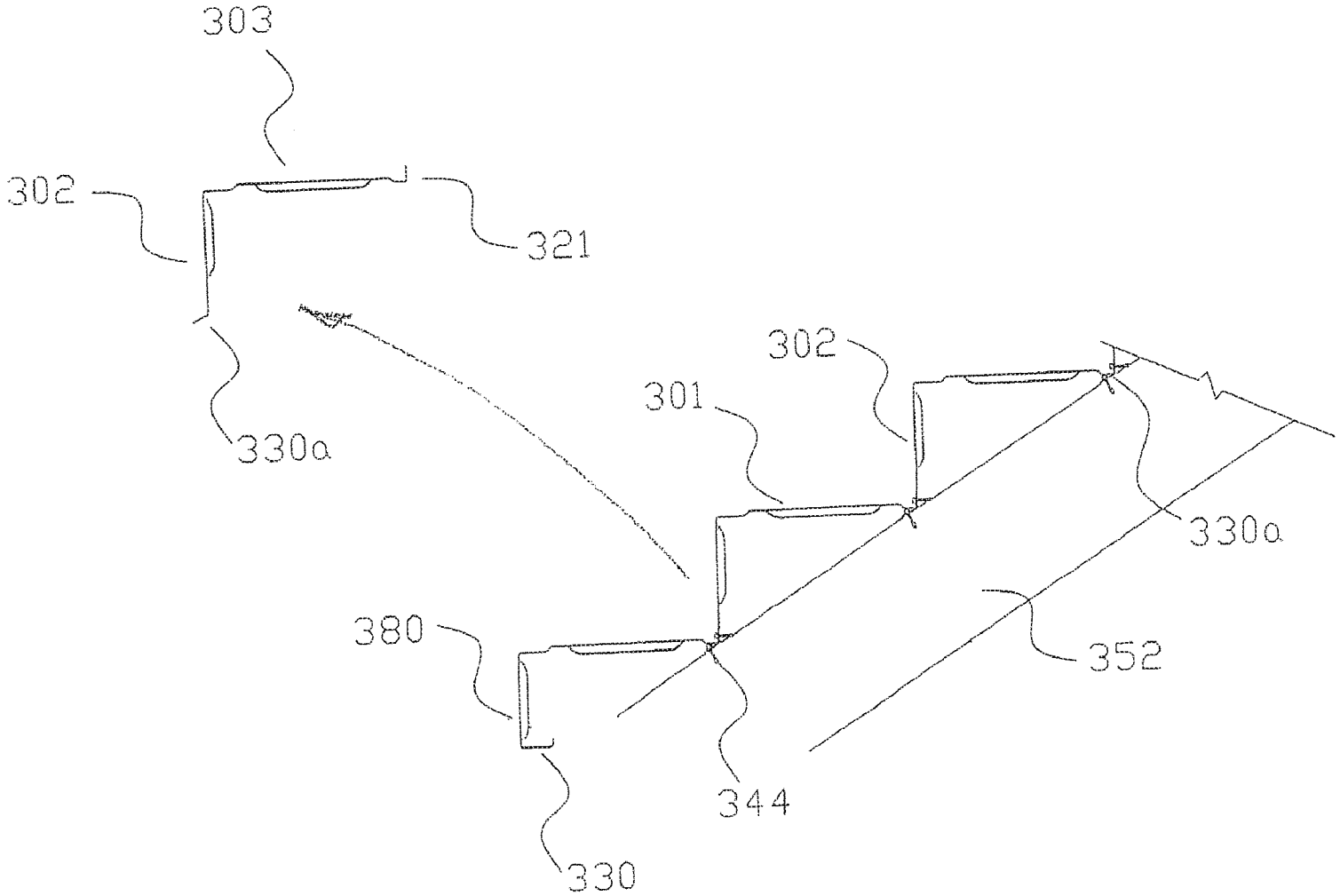
FIG. 24 is a side elevation similar to FIG. 19 of a yet further alternative.

As best seen in FIGS. 23 and 24, alternatively, the flange 330 may be turned out to form a ledge 330*a* to receive the next adjacent stair tread joist, thereby providing for a fixed stair riser dimension and simplifying assembly. The ledge 330*a* may be fixed at a right angle so as to be horizontal in use as shown in FIG. 23, through to an angle matching the supporting stringer 352 as shown in FIG. 24. The ledge is attached with fasteners 344 to side plates 350 as shown in FIG. 23 or directly to the stringer as shown in FIG. 24. The flange 321 of the lower joist 301 is connected by fasteners 344 to the ledge 330*a*. Alternatively, the flange 321 of the lower joist 301 may be connected by fasteners 344 to the lower edge of the web portion 302 to permit some adjustment to the riser height. Similar connections are made with successive joists until the required number of treads is obtained. The final bottom tread 380 is normally provided with the inturned flange 330 to allow for finish surfaces to be applied. Thereafter finish surfaces can be attached to the tread portions 303 and the riser portion 302.

What is claimed is:

1. A metal joist for assembly with like joists to provide a deck assembly, said joist being formed from a continuous sheet and having a web portion and a deck portion extending orthogonally from the web portion and defining a generally planar surface, said deck portion having an exposed planar shelf section formed by an offset at the intersection of the web portion and deck portion to lie below the general planar surface of the deck portion and parallel thereto, said shelf section having an exposed support surface connected to said deck portion by an uninterrupted wall disposed at an angle to said deck portion, an offset at a distal edge of the deck portion to provide a planar tail, said tail extending parallel to and displaced from said general planar surface of the deck portion, said tail having an exposed abutment surface narrower than said exposed support surface and an oppositely directed fastening surface, said offsets being relatively dimensioned such that when said abutment surface of a tail of one joist is supported on the support surface of a shelf section of an adjacent joist, the deck portions lie in a common plane with said fastening surface of said tail being below said common plane and unencumbered by a shelf section to receive a fastener whereby said abutment surface of said tail is slidable on said exposed support surface of said shelf section to permit lateral adjustment between said shelf section and said tail in a plane parallel to said general planar surface of the deck portion whilst maintaining said abutment face in contact with said support surface over the entire extent of said abutment surface.

2. A joist according to claim 1 wherein ribs are formed in at least one of the web portion and deck portion and extend laterally relative to the longitudinal axis of the joist.

3. A joist according to claim 2 wherein said ribs are formed in each of said web portion and deck portion and extend laterally relative to the longitudinal axis of the joist.

4. A joist according to claim 2 wherein said ribs are recessed from said generally planar surface.

5. A joist according to claim 2 wherein said ribs are part circular in cross section.

6. A joist according to claim 1 wherein a flange is formed at the free edge of the web portion and extends orthogonal to the web portion.

7. A joist according to claim 6 wherein said flange extends in a direction opposite to said deck portion.

8. A joist according to claim 6 wherein said flange extends in the same direction as said deck portion.

9. A joist according to claim 6 wherein said flange terminates in a return extending generally perpendicular to the flange to impart stiffness thereto.

10. A deck assembly having a plurality of joists extending side by side and connected to one another, each of said joists being formed from a continuous sheet of metal and each having a web portion and a deck portion extending orthogonally from the web portion and defining a generally planar surface, said deck portion having a an exposed planar shelf section formed by an offset at the intersection of the web portion and deck portion to lie below the general planar surface of the deck portion and parallel thereto, said shelf section having an exposed support surface connected to said deck portion by an uninterrupted wall disposed at an angle to said deck portion, an offset at a distal edge of the deck portion to provide a planar tail, said tail extending parallel to and displaced from said general planar surface of the deck portion, said tail having an exposed abutment surface narrower than said exposed support surface and an oppositely directed fastening face, said joists being arranged with an abutment surface of one of said tails being supported on a support surface of an adjacent one of said joists being connected to one another by a fastener extending from said fastening face through said tail of one joist and into a shelf section of another of said joists, said offsets being relatively dimensioned such that when a tail of one joist is supported on the shelf section of an adjacent joist, the deck portions lie in a common plane with said fastening surface of said tail being below said common plane and unencumbered by said shelf section to receive a fastener whereby said abutment surface of said and said tail is slidable on said shelf section to permit lateral adjustment between said shelf section and said tail in a plane parallel to said general planar surface of the deck portion whilst maintaining said abutment face in contact with said support surface over the entire extent of said abutment surface.

11. A deck assembly according to claim 10 wherein ribs are formed in at least one of the web portion and deck portion and extend laterally relative to the longitudinal axis of the joist.

12. A deck assembly according to claim 11 wherein ribs are formed in each of said web portion and deck portion extend laterally relative to the longitudinal axis of the joist.

13. A deck assembly according to claim 11 wherein said ribs are recessed from said generally planar surface.

14. A deck assembly according to claim 13 wherein said ribs are part circular in cross section.

15. A deck assembly according to claim 10 wherein a flange is formed at the free edge of the web portion and extends orthogonal to the web portion.

16. A deck assembly according to claim 15 wherein said flange extends in the same direction as said deck portion.

17. A deck assembly according to claim 15 wherein said flange terminates in a return extending generally perpendicular to the flange to impart stiffness thereto.

18. A deck assembly according to claim 10 wherein said flange extends in a direction opposite to said deck portion.

* * * * *